US009062487B2

(12) United States Patent
Perry et al.

(10) Patent No.: US 9,062,487 B2
(45) Date of Patent: Jun. 23, 2015

(54) CHILD SAFETY CASEMENT OPERATOR COVER

(75) Inventors: Daniel Perry, Reno, NV (US); Peter J. Minter, Reno, NV (US)

(73) Assignee: Interlock USA, Inc., Reno, NV (US)

( * ) Notice: Subject to any disclaimer, the term of this patent is extended or adjusted under 35 U.S.C. 154(b) by 60 days.

(21) Appl. No.: 14/118,066

(22) PCT Filed: May 19, 2012

(86) PCT No.: PCT/US2012/038785
§ 371 (c)(1),
(2), (4) Date: Nov. 15, 2013

(87) PCT Pub. No.: WO2012/159105
PCT Pub. Date: Nov. 22, 2012

(65) Prior Publication Data

US 2014/0069016 A1 Mar. 13, 2014

Related U.S. Application Data

(60) Provisional application No. 61/487,780, filed on May 19, 2011.

(51) Int. Cl.

| | |
|---|---|
| ***E05F 11/02*** | (2006.01) |
| ***E05F 15/00*** | (2015.01) |
| ***E05B 65/00*** | (2006.01) |
| ***E05F 11/24*** | (2006.01) |
| ***E05F 15/40*** | (2015.01) |

(52) U.S. Cl.
CPC ..... *E05F 15/0004* (2013.01); *E05B 65/0014* (2013.01); *E05F 11/24* (2013.01); *E05Y 2800/116* (2013.01); *E05Y 2800/426* (2013.01); *E05F 15/40* (2015.01)

(58) Field of Classification Search
CPC ..... E05Y 2800/424; E05Y 2800/426; E05Y 2800/116; E05B 65/0014; E05F 11/16; E05F 11/18; E05F 11/20; E05F 11/22; E05F 11/24; E05F 11/26; E05F 11/28; E05F 11/30
See application file for complete search history.

(56) References Cited

U.S. PATENT DOCUMENTS

| | | | | |
|---|---|---|---|---|
| 5,036,620 | A * | 8/1991 | Beran et al. | 49/141 |
| 6,606,825 | B2 * | 8/2003 | Lee et al. | 49/342 |
| 2002/0078630 | A1 * | 6/2002 | Lee et al. | 49/342 |
| 2007/0234642 | A1 | 10/2007 | Bildahl et al. | |
| 2010/0101148 | A1 | 4/2010 | Carrier | |
| 2013/0082469 | A1 * | 4/2013 | Derham | 292/277 |
| 2014/0026709 | A1 * | 1/2014 | Derham | 74/528 |
| 2014/0259940 | A1 * | 9/2014 | Meves et al. | 49/350 |

* cited by examiner

*Primary Examiner* — Katherine Mitchell
*Assistant Examiner* — Scott Denion
(74) *Attorney, Agent, or Firm* — DeLio, Peterson & Curcio, LLC; Peter W. Peterson

(57) ABSTRACT

A child safety device for a casement window includes a handle-driven gear reduction assembly having a sensor gear driven at a reduced speed relative to the handle, a sensor arm driven by the sensor gear of the gear reduction assembly and a slider movable between a stop position where rotation of the handle is prevented and a retracted position where rotation is allowed. A spring biases the slider towards the stop position. The slider is held in the retracted position by a catch and is released by the sensor arm to prevent further opening of the window when the sensor gear reaches a predetermined location. The safety device resets when the window is closed and can be overridden to allow full opening of the window by an adult. In the preferred design, the child safety device is a cover that can replace the cover of an existing casement window operator.

20 Claims, 6 Drawing Sheets

CHILD SAFETY CASEMENT OPERATOR COVER

TECHNICAL FIELD

The present invention relates to child safety devices for windows, particularly windows installed in upper floors, which prevent a child from fully opening the window, but allow the window to be partially opened for ventilation. More particularly, the present invention relates to child safety devices for casement type windows.

BACKGROUND ART

A casement type window is a window that opens outward and is hinged along one side. A transparent windowpane is held in a framework, referred to as the casement window "sash," and the sash is hinged along one edge to a fixed window frame. Because a casement window swings outward, a screen for the window must be mounted on the inside.

Mounting the screen on the inside prevents the user from directly accessing the sash to open or close the window. Thus, casement windows are commonly provided with a mechanical device, referred to as a "casement window operator." The casement window operator is mounted at an accessible location on the inside of the window frame and functions to swing the sash open or closed without requiring the screen to be removed.

There are many different known designs for casement window operators, however, they generally all include a base mounted to the inside of the window frame, a handle mounted to the base and one or more operator arms that are driven by the handle. The driven arm or arms apply a force between the window frame and the window sash to swing the casement window sash between the open and closed positions.

A child safety device for windows is a device that prevents children, particularly, children five and younger, from opening a window sufficiently to fall out of the window, while still allowing the window to be partially opened for ventilation. A child safety device also needs to allow an adult to bypass the safety device in order to open the window to its full extent. When the window is closed, after having been fully opened by an adult, the safety device must automatically reset so that the next time the window is opened, it is again limited to the partially open position. A description of the requirements for child safety devices for windows can be found in ASTM F2090: standard Specification for Window Fall Prevention Devices with Emergency Escape (Egress) Release Mechanisms.

There is a need for a child safety device for casement windows and casement window operators. The design of a casement window and of a conventional casement window operator makes it particularly difficult to implement a child safety device.

DISCLOSURE OF INVENTION

Bearing in mind the problems and deficiencies of the prior art, it is therefore an object of one aspect of the present invention to provide a child safety device for a casement window.

It is a further object of the invention to provide in another aspect, a child safety device for a casement window in the form of a modified casement window operator.

It is yet another object of the invention to provide in a further aspect, a child safety device for a casement window in the form of a cover for a casement window operator that can be added or removed from a casement operator to add or remove child safety functions from a conventional casement window operator.

It is still another object of the invention to provide in another aspect, a child safety device for a casement window with a foldable handle for the casement window operator to provide clearance for window treatments and the like.

Still other objects and advantages of the invention will in part be obvious and will in part be apparent from the specification.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
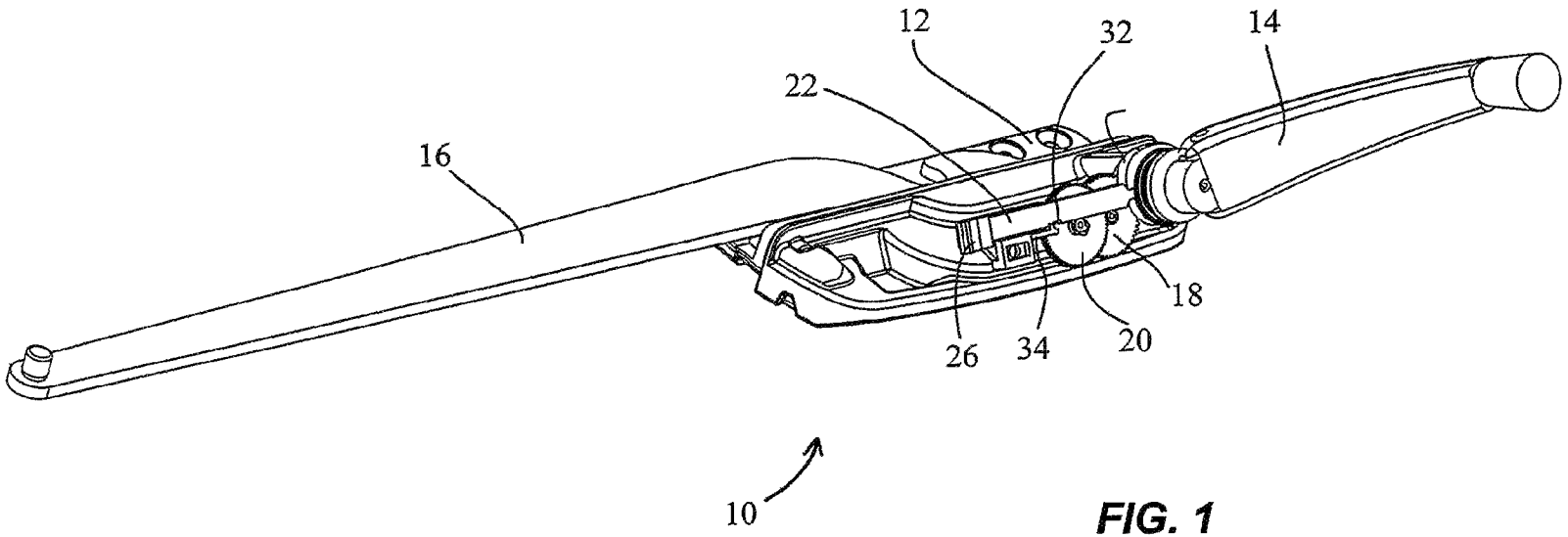
FIG. 1 is a front perspective view of a child safety lock for a casement window according to the present invention showing a complete casement window operator with the child safety lock. Portions of the cover have been cut away for clarity.

In describing the preferred embodiment of the present invention, reference will be made herein to FIGS. 1-6 of the drawings in which like numerals refer to like features of the invention.

Referring to FIGS. 1-6, the present invention is directed to a child safety device incorporated into a casement window operator cover 10. The child safety device of the present invention may be constructed as a complete casement window operator cover including a mounting base 12, an operating handle 14 and an operator arm 16, or it may be constructed as an add-on device for a conventional casement window operator cover.

In the add-on form of the invention, the child safety device casement window operator cover replaces a conventional casement window operator cover. The child safety device casement window operator cover is attached by snapping it on as a replacement for an existing snap-on cover, by mounting it with screws or by other conventional mounting methods.

As is well known in the art, the base 12 is mounted to the window frame and the outer end (not shown) of the operator arm 16 connects to the hinged casement window sash. As the handle 14 is rotated multiple turns, it drives the inner end of the operator arm 16, which then opens and closes the window.

A typical casement window operator takes from eight to seventeen turns to drive the casement window from fully closed to fully open. This means that the rotated position of the handle 14 cannot be used to detect how far the window is open. On the other hand, although the rotated position of the operator arm can indicate the opened extent of the window, the operator arm is driven by gearing, and any stop mechanism would have to resist the geared down force of the rotating handle.

Accordingly, in the present invention, a set of gears 18, 20 are provided, forming a gear reduction assembly to control operation of the child safety device. The outer gear portion of gear 18 is driven by a gear at the base of handle 14. The smaller inner gear portion of gear 18 drives sensor gear 20. The rotation of sensor gear 20 corresponds to the motion of the operator arm 16.

This design allows the sensor gear to signal the position of the window to the child safety device through multiple turns of the handle, while still allowing the stop mechanism to act directly to prevent rotation of the handle.

Extending across the gear assembly 18, 20 is a slider 22 having a stop end 24 at the end closest to the handle and a finger-movable operating end 26 at the opposite end. The operating end 26 is accessible and operable by the user (see FIG. 3) when the mechanism is installed. The slider 22 of the preferred design is slidably movable towards the handle (the stop position) and away from the handle (the retracted position) and is biased with a spring 28 (see FIG. 4) towards the handle, i.e., towards the stop position.

Figure 6:
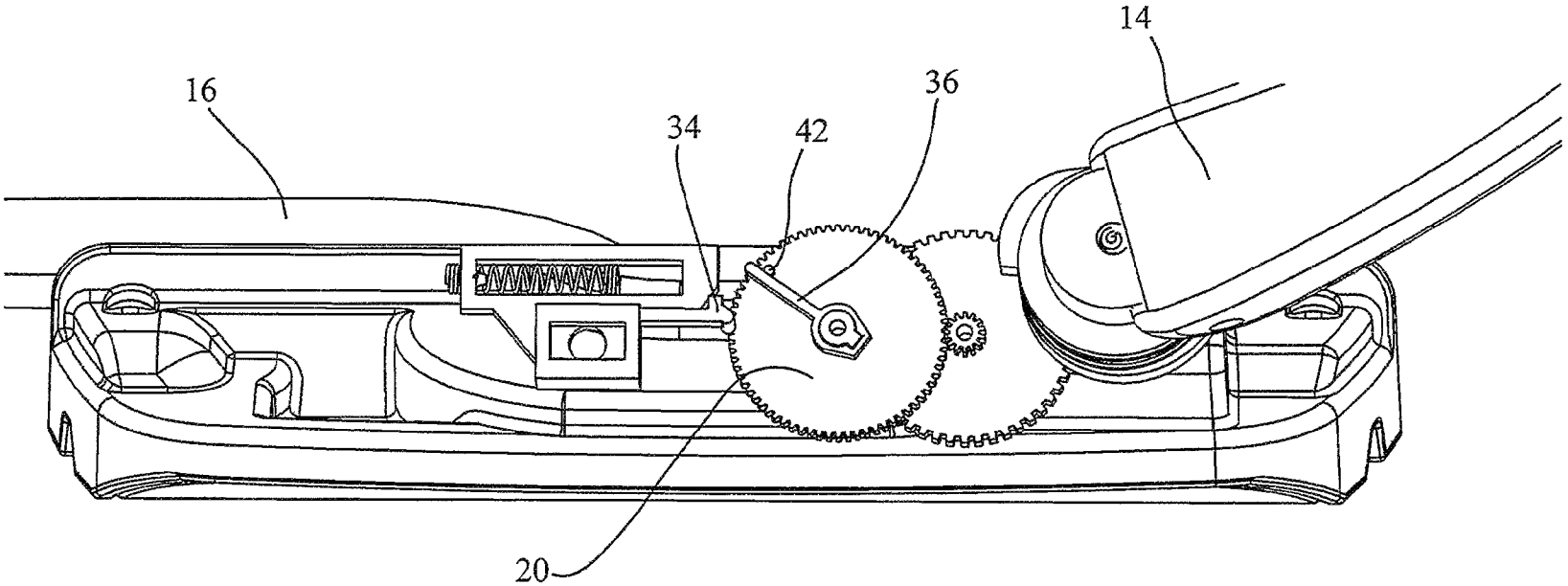
FIG. 6 is a detail perspective view in which the slider has been removed to better show the sensor arm.

When the slider 22 is in the stop position, with the stop end 24 at the closest point to the handle 14, the stop end interferes with rotation of the handle by contacting a step 30 on a collar around the base of the handle 14 (see also FIG. 6, which shows the collar without the slider). This is the position of the slider shown in FIGS. 1 and 2. When the slider is in the retracted position, the stop end is clear of the step 30 on the collar and handle 14 is free to rotate.

It will be noted that the term "slider" is used to denote the element 22 and its function of moving between a stop position and a retracted position. Those of skill in this art will recognize that the slider may be implemented as a component that does not slide, but instead rotates, pivots or moves with another non-sliding motion that allows the slider to reach the two designated positions and interfere with the rotation of the handle with a stop end when in the stop position. When in the stop position, the slider acts as a catch or stop with respect to the handle regardless of the type of motion used by the slider to reach the stop position. The term "slider" is used for convenience only to designate the component of the preferred embodiment and should not be considered a limitation of the type of motion used by the slider to reach the stop position from the retracted position.

Briefly described, the function of the child safety device is as follows. Initially the slider 22 is held in the retracted position (against the biasing force of spring 28) and the handle 14 is free to rotate. In the retracted position, the stop end 24 is clear of the step on the handle 14. As the handle rotates one or more turns, it drives both the operator arm 16 (to open the window) and the gear reduction mechanism 18, 20 (to indicate to the child safety device the opening angle of the window).

Figure 2:
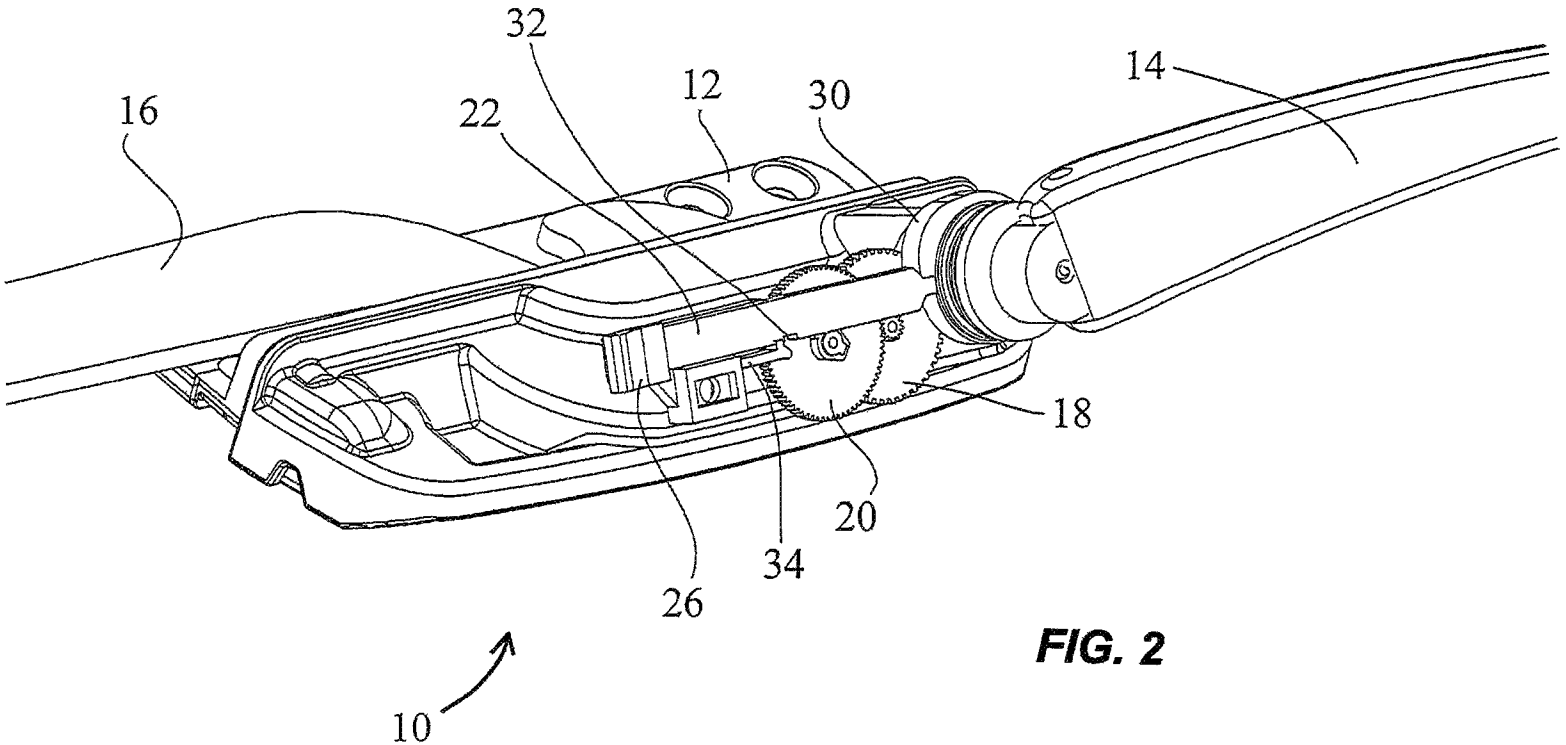
FIG. 2 is a front perspective view of the child safety lock for a casement window seen in FIG. 1. Part of the cover has been cut away for clarity, as in FIG. 1, and a portion of the operator arm has been removed so that the drawing can be shown at an increased scale.
Figure 3:
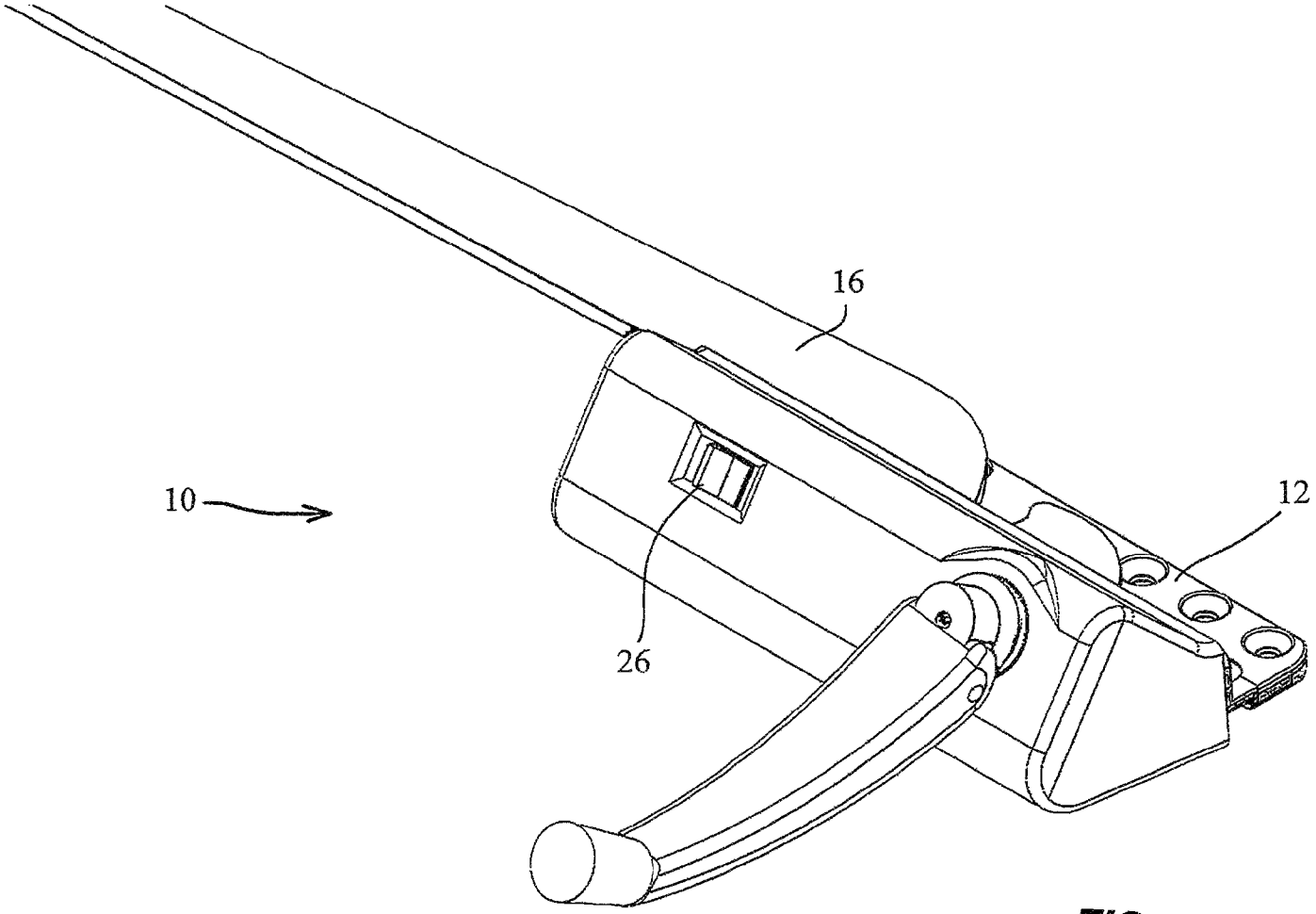
FIG. 3 is a perspective view of the child safety lock for a casement window seen in FIG. 1 showing the cover.
Figure 4:
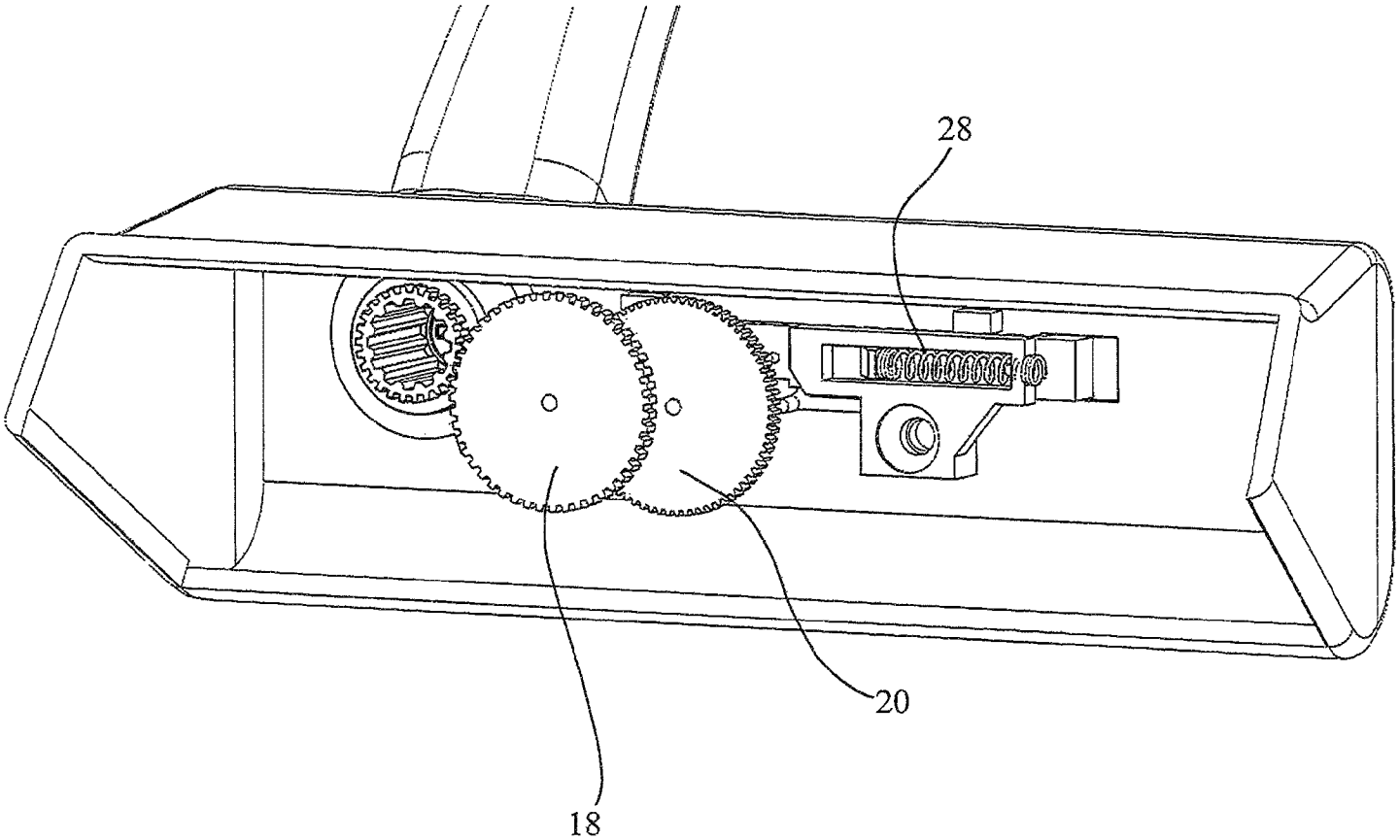
FIG. 4 is a back perspective view of a child safety lock for a casement window according to the present invention. In one aspect of the invention, the cover seen here may be mounted as a replacement cover for a conventional casement window operator having an operator arm and base of the type seen in FIG. 1. Alternatively, the cover shown here may be integrated into a complete casement window operator as shown in FIG. 1.

When the window reaches a predetermined opening angle—sufficient for ventilation, but not for a child to pass through—the slider 22 is released and spring 28 drives it to the stop position seen in FIGS. 1 and 2. The handle 14 is then prohibited from further rotation by contact between the stop end of the slider and the step 30 on the base collar of handle 14.

It will be noted that the stop end of the slider acts to stop rotation of the handle 14, which drives the first gear in the gear train forming the gear reduction mechanism. As described below, however, the catch that releases the slider is triggered by the sensor gear 20, which is located late in the gear train.

Figure 5:
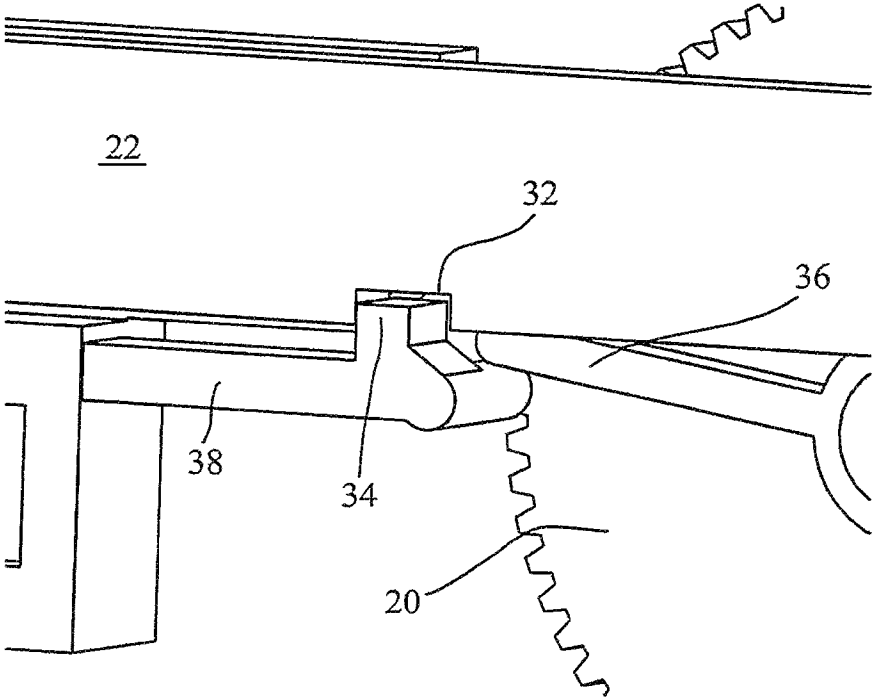
FIG. 5 is a detail perspective view showing a portion of the slider, the catch for holding the slider in the retracted position, the sensor gear and the sensor arm of the present invention.

The mechanism for holding the slider 22 in the retracted position and releasing it to prevent motion beyond the desired opening angle of the window after rotation of the handle 14 will now be described. The slider 22 slides within a guide and the slider includes a detent 32. The guide for the slider includes a catch 34 that engages the detent 32 to hold the slider in the retracted position. FIG. 5 provides a detailed view showing the catch 34 engaging the detent 32 and holding the slider 22 in the retracted position.

As long as the catch 34 is engaged in the detent 32, the slider 22 remains in the retracted position and the handle is free to rotate. As the handle is rotated, however, it drives the sensor gear 20. The sensor gear is provided with a sensor arm 36, which rotates with the sensor gear. The sensor arm 36 is set at a desired angular location relative to the sensor gear such that as the window approaches the desired opening angle for ventilation (and child safety), the tip of the sensor arm strikes a projecting portion of the catch 34.

The term "sensor arm" is used to identify the component that releases the catch that holds the slider. Just as the term "slider is used for convenience to identify the component that moves to stop rotation of the handle, the term "sensor arm" is used merely for convenience to refer to this component in the preferred embodiment of the invention and is not intended to limit the shape or operation of the sensor arm component.

Those of skill in this art will recognize that other structural shapes and components that do not have the shape of an "arm" may be used to release the catch. It is merely required that the component identified as the "sensor arm" here and in the claims act as a release to operate the catch and release the slider when the sensor gear reaches the desired position. For example, the sensor arm might be implemented in a spring loaded design that activates the catch when moving past the catch as the window moves towards the open position and which slides or pivots against a spring loaded biasing force to allow the sensor arm to move past the catch and reset the device when the handle is turned in the opposite direction as the casement window is closed.

The sensor gear 20 rotates in the direction marked 40 in FIG. 5 when the window is being opened by the handle. The catch 34 incorporates a flexible arm 38, such that the sensor arm 36 can drive the catch 34 out of the detent 32 and release the slider 22 to move to the stop position at the desired angular position for the sensor gear. Because the rotation of the sensor gear corresponds to the rotation of the window, the sensor arm can trigger the slider to stop further opening of the window at the desired opening angle.

FIG. 6 shows the position of the mechanism when the window is fully closed. The slider has been removed from FIG. 6 to show the sensor arm 36 below the slider. The sensor arm 36 is also flexible and can bend and move slightly at its tip relative to the surface of the sensor gear 20. A pin 42 projects upwards from the surface of the sensor gear 20. This pin prevents the sensor arm 36 from flexing as it passes by the catch 34 when moving in direction 40. However, when the window is being closed, and the sensor gear is rotating in the opposite direction, the sensor arm 36 flexes to pass by the catch 34. This functions to reset the sensor arm to the position seen in FIG. 6 and thereby reset the child safety device.

The flexible arm 38 of the catch 34 urges the catch towards the slider 22, but the catch cannot reengage the detent 32 until the slider is moved back to the retracted position. This may be accomplished by overriding the child safety feature from the operating end 26 (by manually sliding the slider to the refracted position) or by the cam action of the collar around the handle 14.

In either case, the window is always prevented from being opened beyond the predetermined child safety opening angle by the interaction between the slider, the catch and the sensor arm. When the window is closed, the sensor gear drives the sensor arm beyond the catch 34 and the child safety feature resets. When the window is opened towards the maximum safe permissible opening angle, the sensor arm 36 always releases the catch causing the slider to move to the stop position and limit the opening angle of the window.

Regardless of whether the slider is in the retracted or stop position, the handle can always be rotated to close the window. Such action always causes the mechanism to reset. By adjusting the location of the sensor arm relative to the sensor gear, the point at which the catch is released can be changed. This allows the mechanism to be adjusted to work with different casement window sizes and casement window operators.

As may be seen in FIGS. 1-6, the handle is preferably a folding handle, which provides clearance between the handle and any adjacent structure or window treatment.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A child safety device for a casement window comprising:

a casement window operator cover engageable with a casement window operator driven by a handle;

a gear reduction assembly mounted in the casement window operator cover;

the gear reduction assembly including a sensor gear driven at a reduced speed relative to rotation of the handle;

a sensor arm driven by the sensor gear of the gear reduction assembly;

a slider movable between a stop position and a retracted position, a biasing spring connected to bias the slider towards the stop position;

the slider including a stop end that prevents further opening of the casement window in a less than fully opened position of the casement window and the slider is in the stop position; and a catch for holding the slider in the retracted position against the biasing spring, the catch holding the slider in the retracted position until the sensor arm reaches a predetermined position and releases the catch to allow the slider to move to the stop position.

2. The child safety device for a casement window according to claim 1 wherein the stop end of the slider prevents rotation of the handle when the slider is in the stop position.

3. The child safety device for a casement window according to claim 2 wherein the handle includes a step and the stop end of the slider contacts the step to directly prevent rotation of the handle when the slider is in the stop position.

4. The child safety device for a casement window according to claim 1 wherein the handle is connected to drive the gear reduction assembly and an operator arm, and the operator arm is connected to drive the casement window between fully closed and fully open positions.

5. The child safety device for a casement window according to claim 4 wherein the handle rotates between eight and seventeen turns to drive the casement window from the fully closed position to the fully open position.

6. The child safety device for a casement window according to claim 1 wherein the gear reduction assembly includes a first gear turned by the handle at a reduced speed relative to rotation of the handle.

7. The child safety device for a casement window according to claim 6 wherein the first gear drives the sensor gear.

8. The child safety device for a casement window according to claim 6 wherein the first gear comprises an outer gear portion driven by the handle and an inner gear portion having a smaller diameter than a diameter of the outer gear portion.

9. The child safety device for a casement window according to claim 8 wherein the inner gear portion of the gear reduction assembly drives the sensor gear and the sensor gear has a diameter greater than the diameter of the inner gear portion of the first gear.

10. The child safety device for a casement window according to claim 1 wherein the slider slides between the retracted position and the stop position.

11. The child safety device for a casement window according to claim 10 wherein the slider slides within a guide between the retracted position and the stop position.

12. The child safety device for a casement window according to claim 11 wherein the slider includes a detent and the catch engages the detent to hold the slider in the retracted position until the sensor arm reaches the predetermined position and releases the catch.

13. The child safety device for a casement window according to claim 1 wherein the sensor arm is a flexible arm that flexes to allow the sensor arm to pass by the catch.

14. The child safety device for a casement window according to claim 13 wherein the flexible arm releases the catch when moving past the catch in a first direction as the casement window is driven by the handle towards the open position and wherein the flexible arm flexes to allow the sensor arm to pass by the catch and reset the child safety device when the flexible arm moves past the catch in a direction opposite to the first direction as the casement window is driven by the handle to the closed position.

15. The child safety device for a casement window according to claim 1 wherein the handle is a folding handle.

16. The child safety device for a casement window according to claim 1 wherein the sensor arm moves relative to the sensor gear to allow the sensor arm to reset and thereby reset the child safety device as the handle is turned to move the casement window to the closed position.

17. The child safety device for a casement window according to claim 1 wherein the slider includes an operating end opposite to the stop end, the operating end being accessible to an adult user and allowing the adult user to move the slider away from the stop position and thereby permit the window to be opened fully.

18. A child safety device for a casement window operator comprising:

a base mountable to a casement window frame;

an operator arm connectable to a casement window for moving the casement window between open and closed positions;

a gear reduction assembly mounted in the base;

a handle connected to drive the gear reduction assembly;

the gear reduction assembly including a sensor gear driven at a reduced speed relative to rotation of the handle;

a sensor arm driven by the sensor gear of the gear reduction assembly;

a slider movable between a stop position and a retracted position, a biasing spring connected to bias the slider towards the stop position;

the slider including a stop end that interacts with the gear reduction assembly to stop rotation of the gear reduction assembly to prevent further opening of the casement window in a less than fully opened position of the casement window and the slider is in the stop position; and a catch for holding the slider in the retracted position against the biasing spring, the catch holding the slider in the retracted position until the sensor arm reaches a predetermined position and releases the catch to allow the slider to move to the stop position.

19. The child safety device for a casement window according to claim 18 wherein the handle includes a step and the stop end of the slider contacts the step to directly prevent rotation of the handle when the slider is in the stop position.

20. A casement window operator cover in combination with a casement window operator wherein:

the casement window operator is driven by a handle; and the casement window operator cover is mountable as a cover on the casement window operator to improve child safety, the casement window operator cover further including:

a gear reduction assembly mounted in the casement window operator cover;

the gear reduction assembly including a sensor gear driven at a reduced speed relative to rotation of the handle;

a sensor arm driven by the sensor gear of the gear reduction assembly;

a slider movable between a stop position and a retracted position, a biasing spring connected to bias the slider towards the stop position;

the slider including a stop end that prevents further opening of the casement window in a less than fully opened position of the casement window and the slider is in the stop position; and a catch for holding the slider in the retracted position against the biasing spring, the catch holding the slider in the retracted position until the sensor arm reaches a predetermined position and releases the catch to allow the slider to move to the stop position.

* * * * *